US005485968A

United States Patent [19]

Fujioka

[11] Patent Number: 5,485,968

[45] Date of Patent: Jan. 23, 1996

[54] TAKE-UP REEL FOR METALLIC FILAMENT

[75] Inventor: Kaoru Fujioka, Tochigi, Japan

[73] Assignee: Bridgestone Metalpha Co., Ltd., Tokyo, Japan

[21] Appl. No.: 125,376

[22] Filed: Sep. 22, 1993

[30] Foreign Application Priority Data

Sep. 28, 1992 [JP] Japan ..... 4-282388

[51] Int. Cl.[6] ..... B65H 75/28; B65H 51/015

[52] U.S. Cl. ..... 242/125.2; 242/172

[58] Field of Search ..... 242/125.2, 125.1, 242/125.3, 129, 164, 172, 25 R

[56] References Cited

U.S. PATENT DOCUMENTS

| | | | |
|---|---|---|---|
| 1,408,261 | 2/1922 | Brookhart | 242/125.2 |
| 1,441,462 | 1/1923 | Tuttle | 242/125.1 |
| 2,374,111 | 4/1945 | Le Tourneau | 242/125.1 |
| 4,715,557 | 12/1987 | Rushing et al. | 242/125.1 |
| 4,718,633 | 1/1988 | Weixel | 242/129 |
| 5,062,580 | 11/1991 | Meagher | 242/125.2 |
| 5,320,301 | 6/1994 | Cross | 242/125.2 |

FOREIGN PATENT DOCUMENTS

| | | | |
|---|---|---|---|
| 875573 | 3/1953 | Germany | 242/125.2 |
| 3-62069 | 6/1991 | Japan . | |

*Primary Examiner*—John P. Darling
*Assistant Examiner*—Michael R. Mansen
*Attorney, Agent, or Firm*—Jordan and Hamburg

[57] ABSTRACT

The metallic-filament take-up reel according to the present invention comprises a winding drum on which a metallic filament is wound, a pair of flanges provided at opposite axial ends of the winding drum to hold, between the opposite inner surfaces thereof, the metallic filament wound on the drum, and a device for retaining the end portion of the metallic filament, provided on at least one of the flanges. The filament retaining device includes a catcher of which a base portion is securely fixed to an outer surface of the flange and an access hole formed in the flange, through which the free end of the catcher is displaced to inside the flange. The free end of the catcher is formed into a hook for retention of the end portion of the metallic filament. The catcher has an intermediate portion extending from the base portion thereof to the hook portion. The intermediate portion is raised from the base portion thereof and then bent at a height from the flange outer surface to extend toward the access hole in the flange. The catcher has a resilience to return the hook portion toward an initial position after the catcher is displaced for catching the end portion of a metallic filament.

8 Claims, 12 Drawing Sheets

TAKE-UP REEL FOR METALLIC FILAMENT

BACKGROUND OF THE INVENTION

The present invention relates to a reel for a metallic filament such as wire, rod, stripe or the like thereon.

FIGS. 1 to 3 show a typical prior-art metallic-filament take-up reel. In the Figures, the reference numeral 1 denotes a metallic filament 1 such as steel wire, steel cord or the like. As shown in FIG. 1, the reel consists of a cylindrical drum 2 on which the metallic filament 1 is wound and a pair of disk-like flanges 3 provided at opposite axial ends of the drum 2 to hold, between the opposite inner surfaces thereof, the metallic filament 1 wound on the drum 2. As shown in FIG. 2, the outer circumference of each flange 3 is formed, by rounding it outwardly, into an annular tubular reinforcement 31. Also, the right flange 3 has provided thereon a means 100 of retaining the end portion 11 of the metallic filament 1 wound on the drum 2. The filament retaining means 100 consists of an elongated hole 101 formed in the flange 3 along the reinforcement 31 thereof and a generally "U"-shaped catcher 102 provided on the outer surface of the flange 3 in the proximity of the elongated hole 101. The elongated hole 101 is formed to such a size and shape that the end portion 11 of the metallic filament i can be partially pulled out, as bent in a nearly "U" shape, from inside the inner surface to outside the outer surface of the flange 3. FIG. 3 shows the end portion 11 of the metallic filament 1 partially pulled outside the flange 3 and caught by the catcher 102. The catcher 102 has a resilience to force the central apex thereof to the outer surface of the flange 3 as shown in FIG. 3. Thus, the metallic filament 1 is securely retained at a part of the end portion 11 thereof caught between the outer surface of the flange 3 and the catcher 102. The end portion 11 of the metallic filament 1, as stated herein, refers to a portion extending from the extremity of the metallic filament 1 and having a length nearly equal to the radius of the flange 3.

The retaining means 100 of the prior-art metallic-filament take-up reel shown in FIGS. 1 to 3, requires that the end portion 11 of the metallic filament 1 be partially pulled out, from inside the inner surface, through the elongated hole 101, to outside the outer surface of the flange 3. The task of pulling out the metallic filament 1 is difficult to automate and must be done by hand, which causes work efficiency to be low and require excess labor in the metallic-filament retaining process. Further, the end portion 11 of the metallic filament 1 is only retained by the resilience of the U-shaped catcher 102 toward the outer surface of the flange 3 by the parallel arms of the U-shape catcher 102. Therefore, if the force which tends to unwind the metallic filament 1 wound on the drum 2 is greater than the resilience of the catcher 102, the wound metallic filament 1 is likely to be loosened and may possibly be released from the catcher 102.

SUMMARY OF THE INVENTION

Accordingly, an object of the present invention is to overcome the above-mentioned drawbacks of the prior art by providing a metallic-filament take-up reel which permits to simple and reliable retention of the end portion of a metallic filament wound thereon, prevents the wound metallic filament from being loosened without any limitation on a winding capacity thereof by the provision of a means of retaining the metallic-filament end portion, and allows the metallic filament to be unwound therefrom easily and smoothly with no entangling of the filament.

The above object is accomplished by providing a reel according to the present invention comprising a winding drum on which a metallic filament is wound, a pair of flanges provided at the opposite axial ends of the winding drum to hold, between the opposite inner surfaces thereof, the metallic filament wound on the drum, and a means of retaining the end portion of the metallic filament, provided on at least one of the flanges. The filament retaining means consists of a catcher of which the base portion is securely fixed to the outer surface of the flange and an access hole formed in the flange through which the free end of the catcher can be led to inside the flange. The free end of the catcher is formed into a hook for retention of the end portion of the metallic filament. The catcher has an intermediate portion extending from the base portion thereof to the hook portion. The intermediate portion is raised from the base portion thereof, then bent at a height from the flange outer surface and extended toward the access hole in the flange. The catcher has resilience to return the hook portion to its initial position after the catcher itself is bent for catching the end portion of the metallic filament. After the metallic filament is wound on the drum into a layer of which the thickness has come up to the level of the access hole, the hook portion of the catcher is depressed inside the inner surface of the flange, through the access hole, against the resilience of the catcher, and the end portion of the metallic filament is caught by the hook portion. When the force is taken off the catcher after the end portion of the metallic filament is caught by the hook portion, the resilience of the catcher returns the hook portion to outside the flange through the access hole. However, since the filament is long enough as to extend over the access hole, the end portion of the metallic filament will block the hook portion from returning from inside the inner surface to outside the outer surface of the flange. In this condition, the end portion of the metallic filament will be forced to the inner surface of the flange, where the access hole is formed, due to the resilience of the catcher. Thus, the end portion of the metallic filament can be retained easily and positively. Also, the possibility that the metallic filament, once wound on the drum and thus retained at the end portion thereof, will be loosened is reduced. Furthermore, the access hole is preferably just large enough so that the hook portion can be moved through it, and also the hook portion is preferably just large enough to be capable of catching the metallic filament. The access hole may thus be small. Therefore, the metallic filament can be wound on the drum to such a layer as will not close the access hole. That is, the metallic filament may be taken up on the drum to the nearly full winding capacity of the reel.

These and other objects and advantages of the present invention will be better understood from the ensuing description, made by way of example, of the embodiments of the metallic-filament take-up reel according to the present invention with reference to the drawings.

DETAILED EMBODIMENT OF THE PREFERRED EMBODIMENTS

Figure 4:
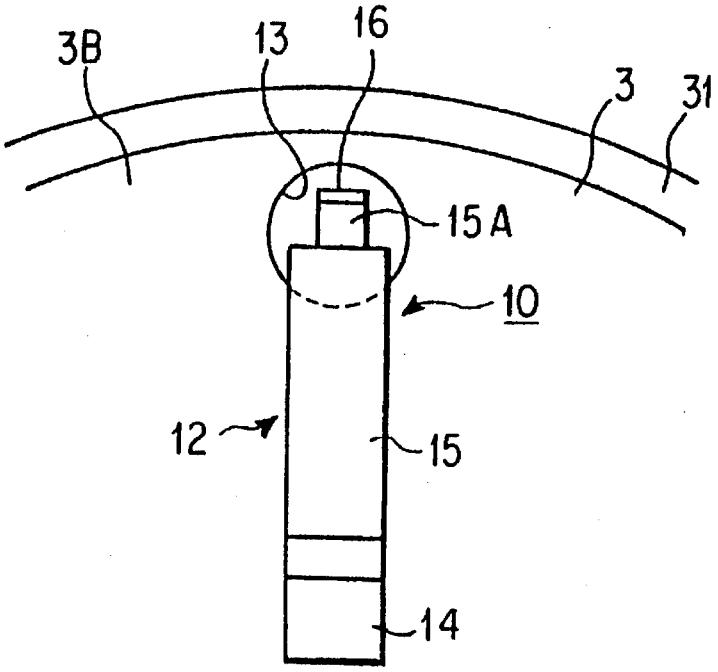
FIG. 4 is a front view, partially enlarged in scale, of the filament retaining means in a first embodiment of the metallic-filament take-up reel according to the present invention.
Figure 5:
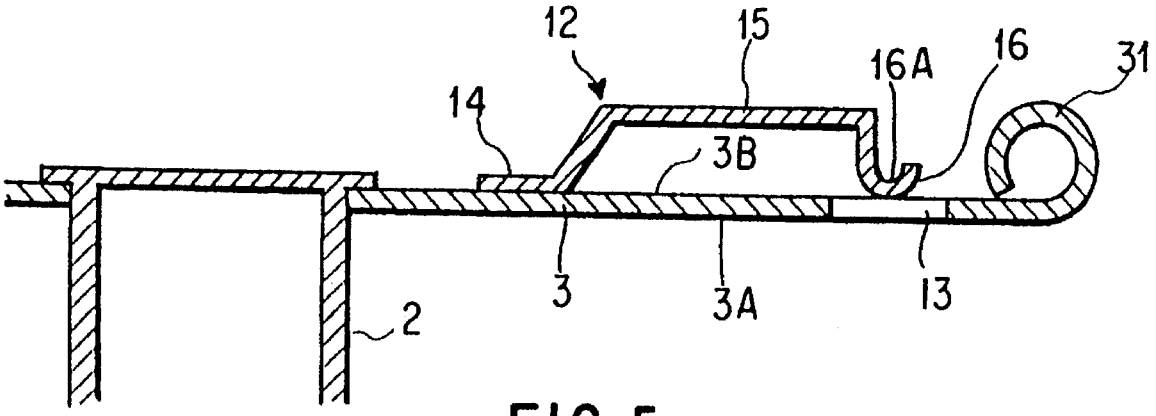
FIG. 5 is a sectional view of the filament retaining means in FIG. 4.

FIGS. 4 and 5 show a first embodiment of the metallic-filament take-up reel according to the present invention. The reference numeral 1 denotes a metallic filament. The reel according to the present invention includes a winding drum 2 on which the metallic filament 1 is wound, and a pair of flanges 3 provided at the opposite axial ends of the winding drum 2 to hold, between the opposite inner surfaces 3A thereof, the metallic filament 1 wound on the drum 2. The outer circumference of each flange 3 is formed by swaging it outwardly into an annular and tubular reinforcement 31. A means 10 of retaining an end portion 11 of the metallic filament 1 is provided on the outer surface 3B of at least one of the flanges 3 in pair. The filament retaining means 10 consists of a catcher 12 provided on the outer surface 3B of the flange 3, and an access hole 13 formed in the flange 3. The catcher 12 comprises a base portion 14 securely fixed on the outer surface 3B of the flange 3, an intermediate portion 15 raised from the base portion 14 so as to be off the outer surface 3B of the flange 3, bent at a height and extending nearly in parallel to the outer surface 3B, and a hook portion 16 contiguous to the intermediate portion 15 and so positioned as to face the access hole 13. The access hole 13 is of such a size that the hook portion 16 is movable through it from outside the outer surface 3B of the flange to inside the inner surface 3A of the flange 3.

The catcher 12 in the first embodiment shown in FIGS. 4 and 5 is made of a metallic leaf spring. The intermediate portion 15 is terminated by the hook portion 16 directed toward the outer surface 3B, that is, toward the access hole 13 in the flange 3. The resilience of the catcher 12 permits the hook portion 16 to easily be moved to outside the flange 3 and go back to its initial position. The hook portion 16 of the catcher 12 is designed narrower than the base portion 14 to allow the access hole 13 may be small. In this embodiment, the catcher 12 is designed 0.3 mm thick, the base and intermediate portions 14 and 15 are 8 mm wide, and the hook portion 16 is 3 mm wide. The intermediate portion 15 is 5 mm off the outer surface 3B when in its initial position parallel to the outer surface 3B, that is, when the catcher 12 is not used to catch the metallic filament 1 by the hook portion 16. The hook portion 16 has a U-shaped recess 16A in which the metallic filament 1 is to be fitted.

Figure 1:
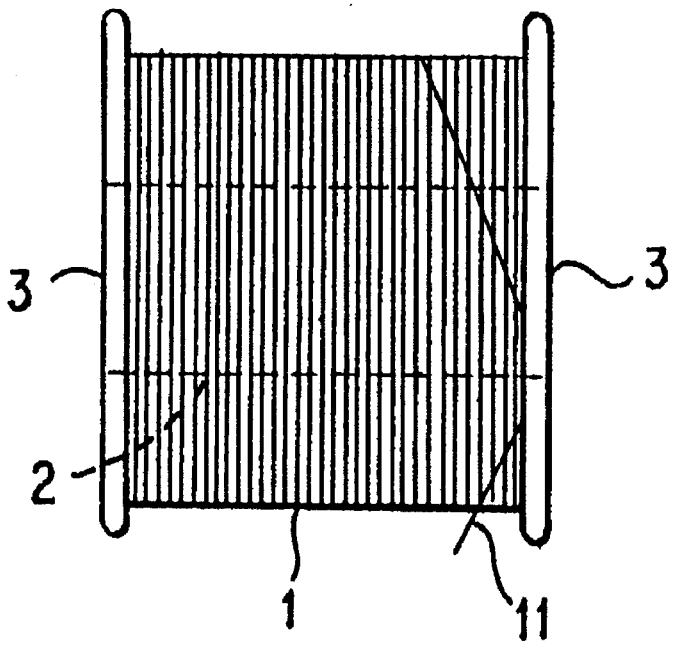
FIG.1 (PRIOR ART)
FIG. 1 is a side elevation of the prior-art metallic-filament take-up reel.
Figure 2:
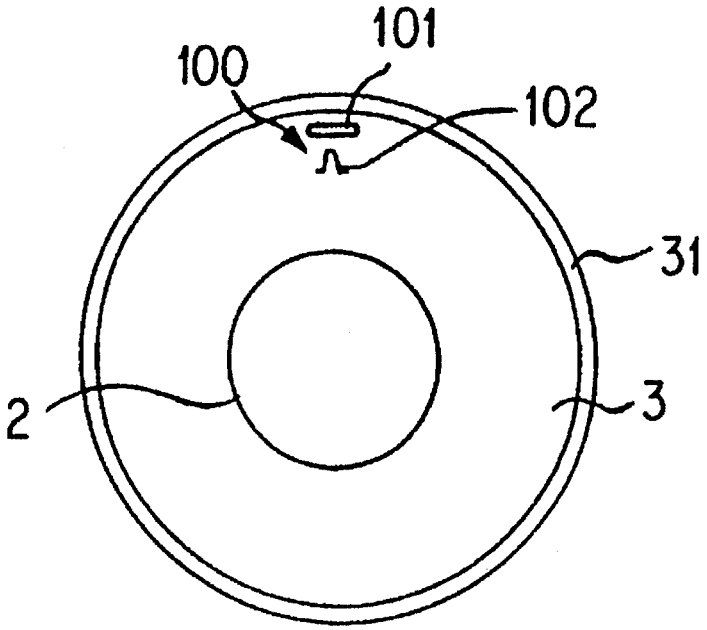
FIG.2 (PRIOR ART)
FIG. 2 is a front view of the prior-art reel.
Figure 3:
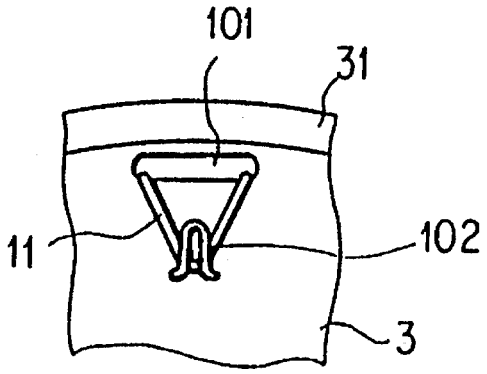
FIG. 3 (PRIOR ART)
FIG. 3 is a front view, partially enlarged in scale, of the filament retaining means provided on the prior-art reel.
Figure 6:
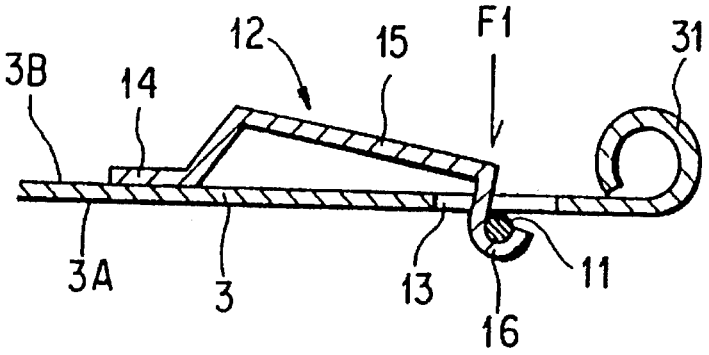
FIG. 6 is a sectional view of the filament retaining means, showing the metallic filament caught at the end portion thereof.

FIG. 6 is a sectional view of the first embodiment, showing the metallic filament 1 being caught at the end portion 11 thereof by the hook portion 16. By lightly pressing the catcher 12 with a force $F_1$, only the hook portion 16 thereof is easily moved into the access hole 13 and further to inside the inner surface 3A of the flange 3. The end portion 11 of the metallic filament 1 wound on the winding drum 2 between the flanges 3 is fitted in the recess 16A of the hook portion 16, and the force $F_1$ is removed in this condition. Then the end portion 11 of the filament 1 is easily retained as caught between the hook portion 16 and the inner surface 3A of the flange 3. In the prior-art metallic-filament take-up reel shown in FIGS. 1 to 3, the end portion 11 of the filament 1 is pressed to the flange 3 by the catcher 102. In this embodiment, however, the end portion 11 of the filament 1 is attracted to the flange 13 by the hook portion 16 of the catcher 12.

According to the present invention, only the hook portion 12, which is extremely small, is resiliently moved to inside the flange 3. Therefore, the access hole 13 is preferably designed to be small so that the metallic filament 1 is wound up to the proximity of the access hole 13 (to the nearly full capacity of the reel).

Figure 7:
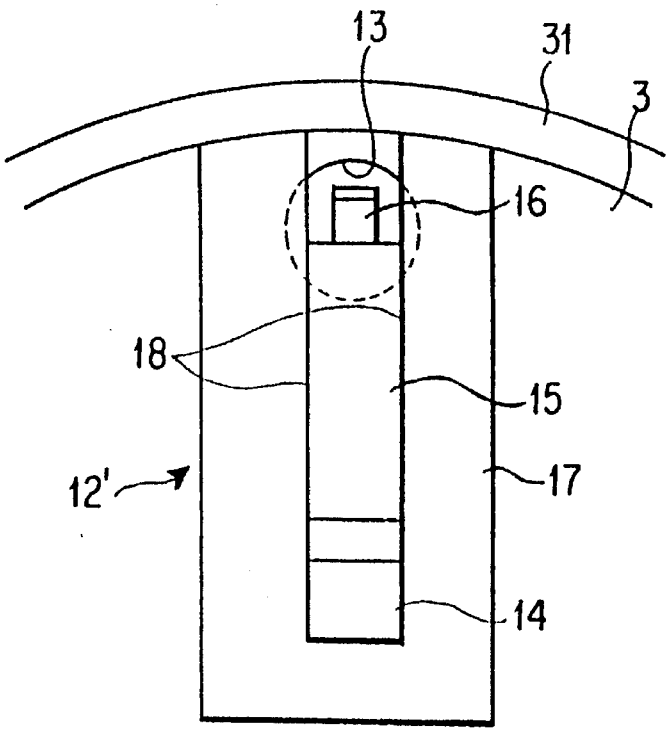
FIG. 7 is a front view, partially enlarged in scale, of the filament retaining means in a second embodiment of the metallic-filament take-up reel according to present invention.
Figure 8:
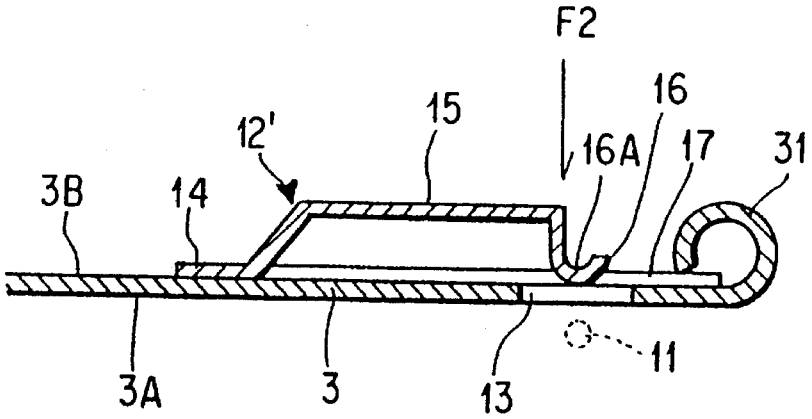
FIG. 8 is a sectional view of the filament retaining means in FIG. 7.

FIGS. 7 and 8 show the second embodiment of the filament take-up reel according to the present invention. In this embodiment, the catcher 121 is made of a resilient steel plate 17. As shown in FIG. 7, two parallel cut lines 18 are formed in the middle of the steel plate 17. The central steelplate portion, after separation along the cut lines 18, is formed into a base portion 14, intermediate portion 15 and a hook portion 16 all similar to those in the first embodiment. The ends of the steel plate portions outside the cut lines 18 are placed under the edge of the reinforcement 31 of the flange 3, and then fixed by swagging under the flange 3. When lightly pressed toward the flange 3 with a force $F_2$, the hook portion 16 of the catcher 12 thus formed can easily be moved from outside the outer surface 3B of the flange 3 through the access hole 13 to inside the inner surface 3A. The end portion 11 of the metallic filament 1 is fitted into the recess 16A of the hook 16 in this condition. When the force $F_2$ is removed after the end portion 11 is fitted into the recess 16A, the end portion 11 is forced to the inner surface 3A of the flange 3 under the resilience of the catcher 12, the resilience causing the hook portion 16 to return to its initial position. Thus the end portion 11 of the filament 1 is securely retained as caught between the inner surface 3A and hook portion 16.

Figure 9:
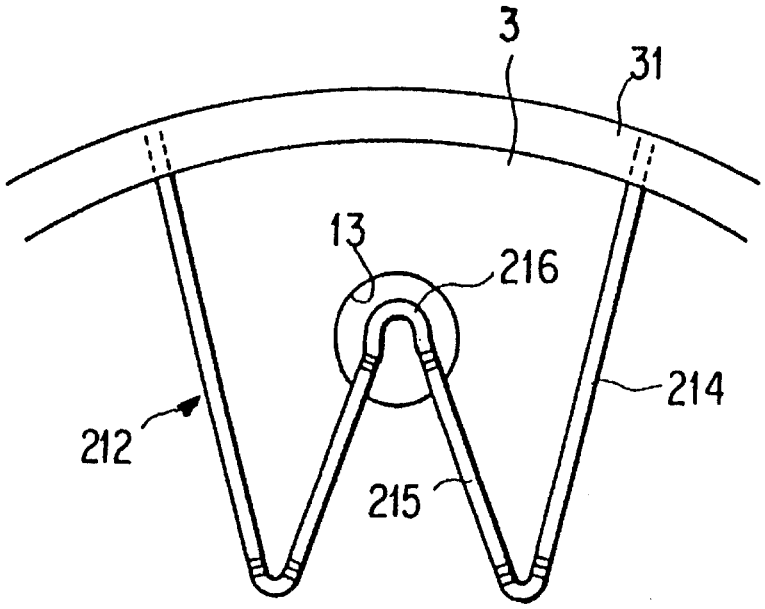
FIG. 9 is a front view, partially enlarged in scale, of the filament retaining means in a third embodiment of the metallic-filament take-up reel according to the present invention.
Figure 10:
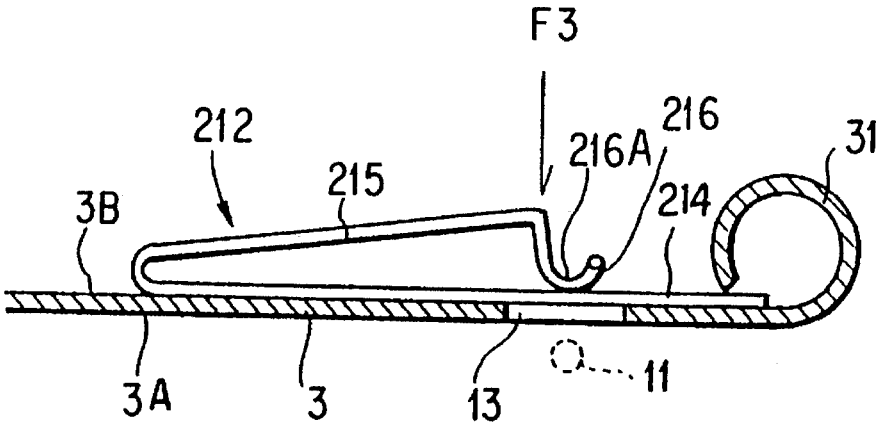
FIG. 10 is a sectional view of the filament retaining means in FIG. 9.

FIGS. 9 and 10 show a third embodiment of the metallic-filament take-up reel according to the present invention. In the third embodiment, a catcher 212 is made of a resilient rod folded into the general planar shape of a character "W" of which the central apex is about 5 mm apart from both the outer arms 214. The central apical portion is bent downward nearly perpendicularly to the outer arms, and the end of the apical portion is curved in a "U" shape. In the catcher 212, both the outer arms 214 serve as the base portion thereof, and are fixed to the flange 3 while both the inner arms 215 serve as the intermediate portion thereof. The central apical U-shaped portion 216 serve as the hook portion (with curved arms of receiver 216A). All these portions work similarly to those in the above first and second embodiments. The outer arms 214 of the catcher 212 are placed under the reinforcement 31 formed along the outer circumference of the flange 3, and then fixed by punching to the flange 3. An access hole 13 is formed in the flange 3 in opposition to the central apical U-shaped portion 16.

In this embodiment, the resilient rod has a diameter of 1 mm. The outer arms 214 are secured in their respective positions 20 mm apart from the access hole 13. The outer arms 214 are extended by the intermediate portions 215, respectively, made as bent at the ends of the outer arms 214 so as to gradually ascend up to a height of about 5 mm from the outer surface 3B of the flange 3, that is, above the access hole 13. Each of the intermediate portions 215 are 25 mm long. The intermediate portions 215 are terminated by the hook portion 216 having the shape of a semicircle of which the diameter is 3 mm. The arms of the hook portion 216, that is, the U-shaped hook portion, are designed to have the shape of an upward curve, when viewed laterally, which forms the receiver 216A for the end portion 11 of the metallic filament 1.

For retaining the end portion 11 of the metallic filament 1, only the hook portion 216 is displaced into the access hole 13 by lightly pressing toward the flange 3 the intermediate portions 215 with a force $F_3$ at a portion thereof, preferably near the hook portion 216. The hook portion can easily be moved because of the resilience. The end portion 11 of the metallic filament 1 is fitted on the hook portion 216, more specifically, in the receiver 216A, and then the force $F_3$ is removed. The end portion 11 of the metallic filament 1 then is retained between the hook portion 16 and the inner surface 3A of the flange 3.

Figure 11:
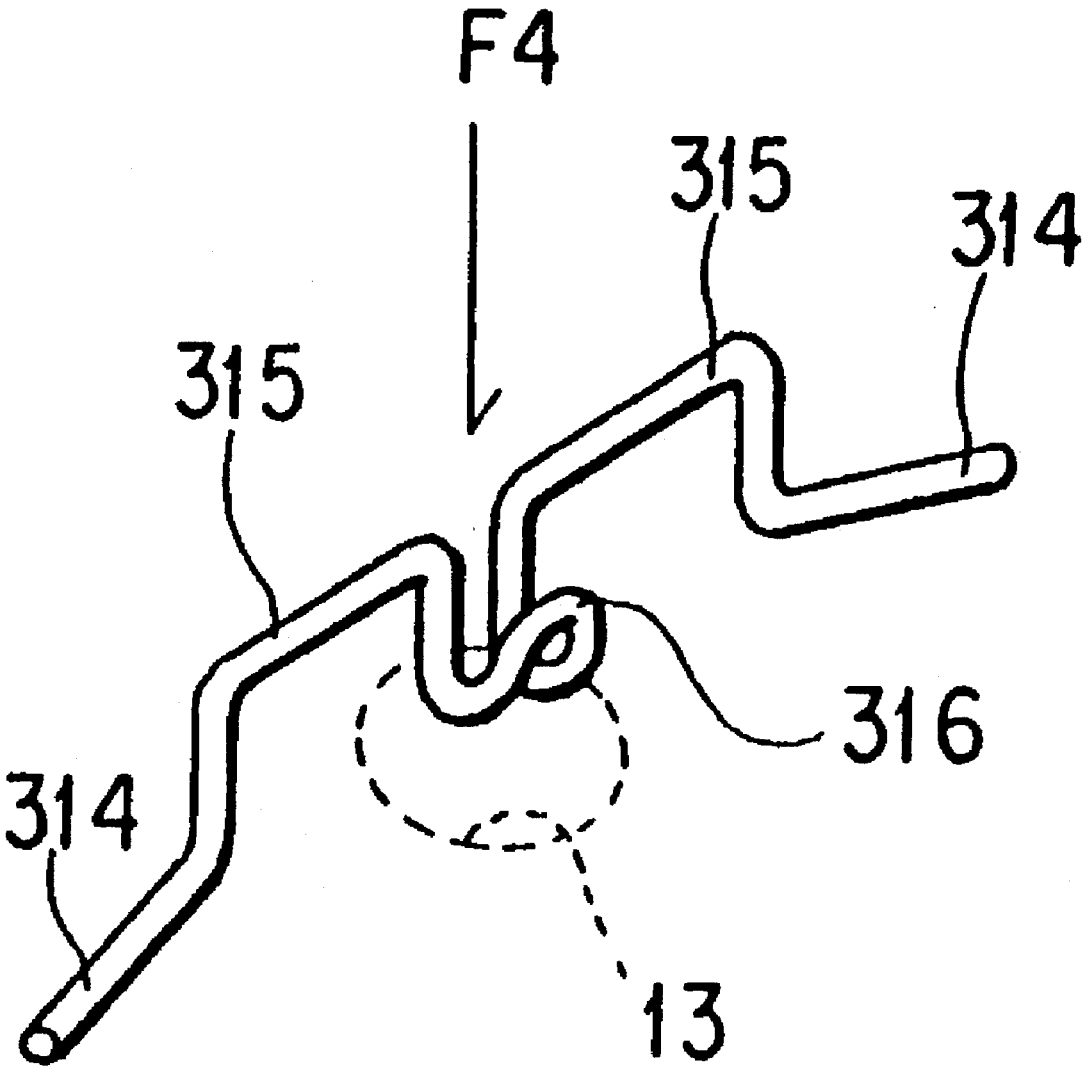
FIG. 11 is a perspective view of the catcher in the filament retaining means in a fourth embodiment of the metallic-filament take-up reel according to the present invention.

FIG. 11 is a perspective view of a catcher 312 used in a fourth embodiment of the metallic-filament take-up reel according to the present invention. In this embodiment, the catcher 312 is made of a resilient rod as in the above third embodiment. The catcher 312 is also composed of base portions 314, intermediate portions 315 and a hook portion 316. The intermediate portions 315 are raised from the base portions 314 and bent at a height of about 5 mm from the base portions 314. The intermediate portions 315 are terminated by the hook portion 316 formed by bending the end portions of the intermediate portions 315 into a "U" shape. The catcher 315 is fixed on the outer surface 3B of the flange 3 in such a manner that the hook portion 316 is opposite to the access hole 13 formed in the flange 3. In the fourth embodiment, the hook portion 316 is easily moved through the access hole 13 to inside the outer surface 3B by applying a force $F_4$ to the intermediate portions 315 of the catcher 312.

Figure 12:
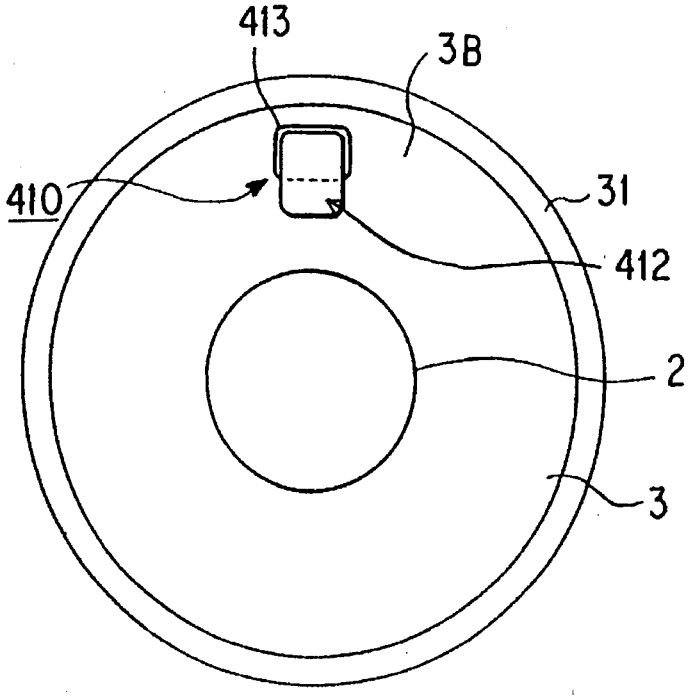
FIG. 12 is a general front view of a fifth embodiment of the metallic-filament take-up reel according to the present invention.
Figure 13:
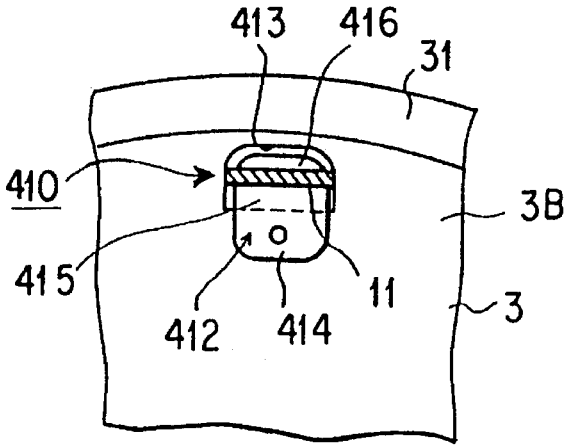
FIG. 13 is a front view, enlarged in scale, of the essential part of the fifth embodiment in FIG. 12.

FIGS. 12 and 13 show a fifth embodiment of the metallic-filament take-up reel according to the present invention. In this embodiment, a catcher 412 comprises a base portion 414 securely fixed to the outer surface 3B of the flange 3, an intermediate portion 415 extending toward the access hole 413 in the flange 3 and a hook portion 416 contiguous to the intermediate portion 415 and positioned to face the access hole 13. The catcher 412 is made of a metallic leaf spring. For retaining the end portion 11 of the metallic filament 1, the hook portion 416 is forced to go to inside the inner surface 3A of the flange 3 through the access hole 413, and then the end portion 11 of the metallic filament 1 is caught between the hook portion 416 and the inner surface 13A of the flange 3.

Figure 14:
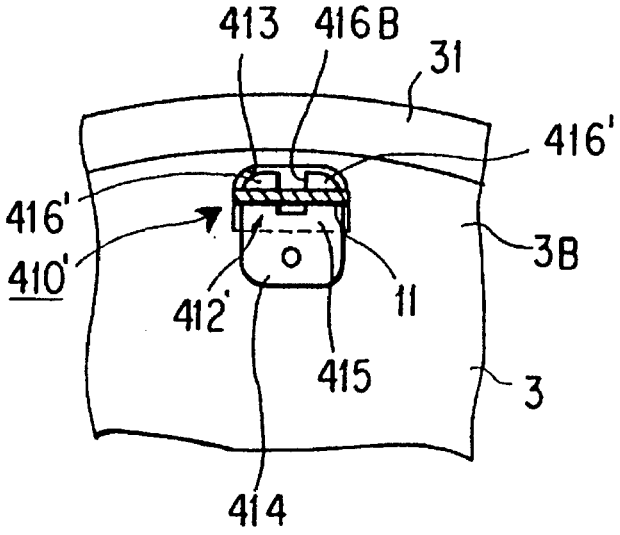
FIG. 14 is a similar front view, enlarged in scale, showing a variant of the hook portion of the filament retaining means in the fifth embodiment.

FIG. 14 shows a variant 410' of the hook portion of the filament retaining means in the fifth embodiment. In this variant, a cut 416B is formed in the center of the hook portion 416. Two free ends 416' of the catcher 412, formed at the opposite sides of the cut 416B, are used to retain the end portion 11 of the metallic filament 1.

Figure 15:
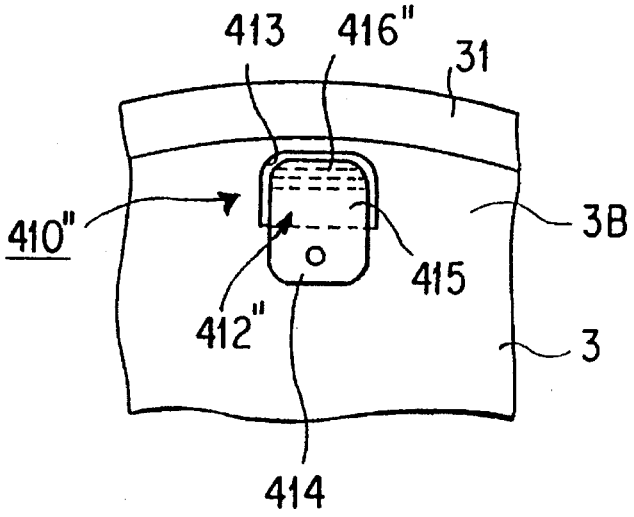
FIG. 15 is a front view, partially enlarged in scale, showing the relation between the flange and hook portion in another variant of the fifth embodiment.
Figure 16:
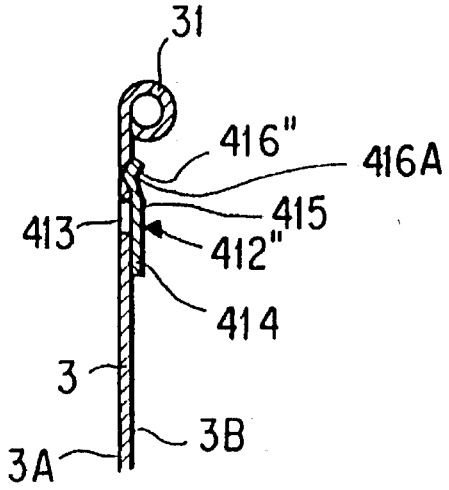
FIG. 16 is an axial sectional view of the essential part of the second variant of the fifth embodiment shown in FIG. 15.
Figure 17:
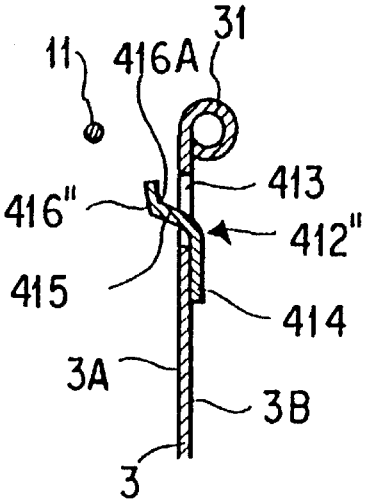
FIG. 17 is a sectional view showing the hook portion of the second variant of the fifth embodiment when Forced to inside the flange.
Figure 18:
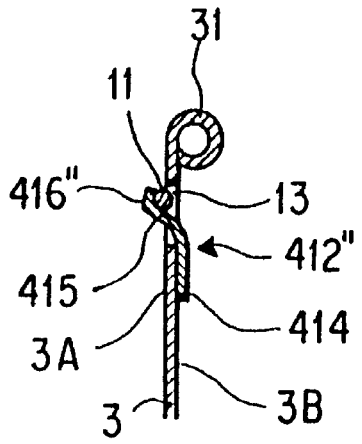
FIG. 18 is a sectional view of the filament retaining means in the second variant of the fifth embodiment, showing the filament retained by the filament retaining means.

FIGS. 15 to 18 show another variant 410' of the fifth embodiment. FIG. 15 is a general view showing the relation between the flange 3 and a hook portion 416. As shown in FIG. 17, the hook portion 416, has formed thereon a recess 417A a little larger than the thickness of the metallic filament 1 and in which the end portion 11 of the metallic filament 1 is caught. The hook portion 416 is forced from a first position shown in FIG. 16 to a second position inside the inner surface 3A of the flange 3 through the access hole 413. In the second position, the resilience of the hook portion 416 acts to return the hook portion 416 to the first position. The end portion 11 of the metallic filament 1 is placed between the hook portion 416" at the second position and the inner surface 3A of the flange 3, then, the force applied to the hook portion 416 is removed. The hook portion 16 return toward the first position as mentioned above, but since the end portion of the metallic filament 1 lies across the access hole 13, the hook portion 416" abuts the end portion 11 of the metallic filament 1 and is blocked from going back any further, as shown in FIG. 18.

Figure 19:
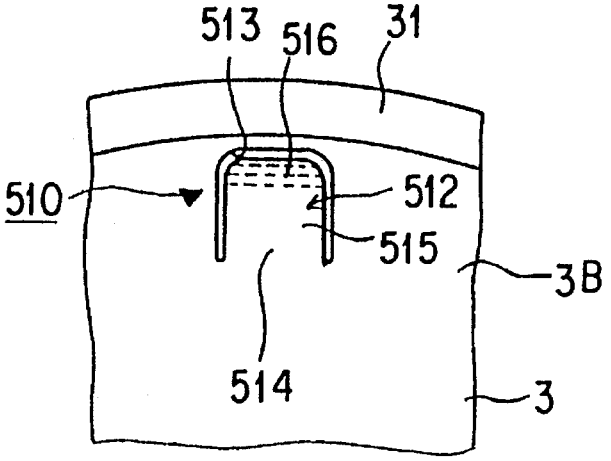
FIG. 19 is a front view, enlarged in scale, of a sixth embodiment of the metallic-filament take-up reel according to the present invention.
Figure 20:
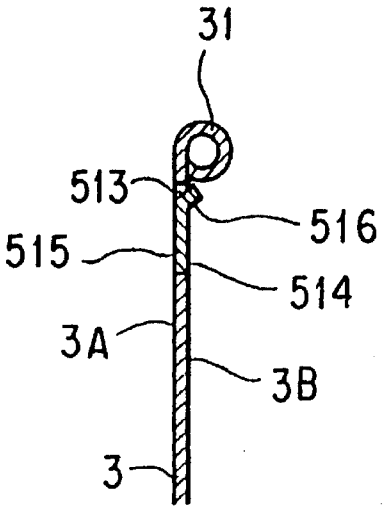
FIG. 20 is an axial sectional view of the essential part of the sixth embodiment shown in FIG. 19.

FIGS. 19 and 20 show the sixth 510 embodiment of the metallic-filament take-up reel according to the present invention. As shown in FIG. 19, an inverted U-shaped cut is formed in the flange 3. A resultant U-shaped opening serves as an access hole 513 while a flange area 512 surrounded by the U-shaped opening forms the catcher. A portion of the flange 3 which lies between both ends of the U-shaped opening serves as the base portion 514, and a free end portion of the flange area 12 thus cut works as the hook portion 516. A flange area between the base portion 514 and hook portion 516 serves as the intermediate portion 515. FIG. 20 is an axial sectional view of the essential part of the sixth embodiment shown in FIG. 19. To retain the end portion 11 of the metallic filament 1, the hook portion 516 is pressed from right to left (as viewed in the drawing). A clearance will result between the hook portion 516 and the inner surface 3A of the flange 3. The end portion 11 of the metallic filament 1 is inserted into the clearance, and then the pressure applied to the hook portion 516 is removed. The hook portion 16 will return to its initial position and thus work in cooperation with the inner surface 3A to retain the end portion 11.

Figure 21:
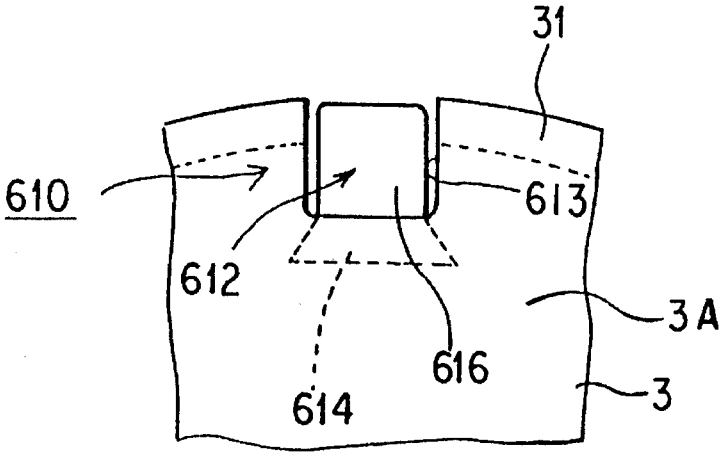
FIG. 21 is a view, partially enlarged in scale, from inside the flange, of a seventh embodiment of the metallic-filament take-up reel according to the present invention.
Figure 22:
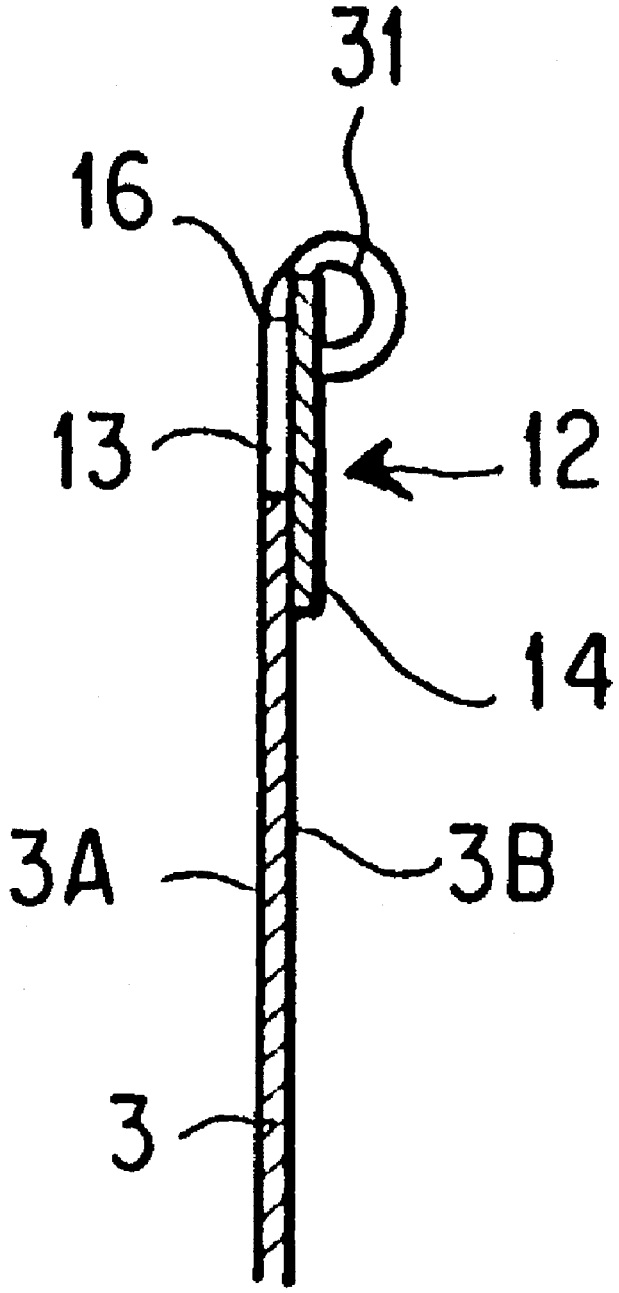
FIG. 22 is an axial sectional view of the essential part of the seventh embodiment shown in FIG. 21.

FIGS. 21 and 22 shows a seventh embodiment 610 of the metallic-filament take-up reel according to the present invention. In the seventh embodiment 610, an access hole 613 is formed over both the flange 3 and reinforcement 31 of the flange 3. The access hole 613 is open at a top end thereof. A portion of a catcher 612 which extends from a base portion 614, as a whole, and serves as the hook portion 616. To retain the end portion 11 of the metallic filament 1, the hook portion 616 is pressed from outside the outer surface 3B of the flange 3 to inside the inner surface 3A. The hook portion 616 is slightly narrower than the access hole 613 so that the hook portion 616 can be deflected from an initial position outside the outer surface 3B of the flange 3 to inside the inner surface 3A. In this case, the resilience of the hook portion 616 causes the hook portion 616 to return to the initial position, so the hook portion 616 retains the end portion 11 of the metallic filament 1 with a greater force.

With the metallic-filament take-up reels according to the present invention, it is not necessary to pass the metallic filament 1 through the hole 101 formed in the flange 3 since the end portion 11 of the metallic filament 1 can be retained on the inner surface 3A of the flange 3, not on the outer surface 3B. Therefore, the metallic filament 1 may not possibly be damaged by any external force. The metallic filament 1 wound on the reel according to the present invention can be transported, stored or unwound from the reel easily, speedily and with a considerably improved efficiency, and the retention of the metallic filament 1 onto the reel can be automated effectively. With only a very small force applied, the hook potions of the catchers can be moved, of each embodiment by temporary deflection through the access holes to inside the inner surface 3A of the flange 3. Therefore, the filament retention to the reel can be done very efficiently. Furthermore, the metallic filament 1 can be wound on the reel to the nearly full capacity thereof.

What is claimed is:

1. A filament take-up reel having a winding drum for accepting a winding of a filament thereon, said take-up reel comprising:

said winding drum having first and second axial ends;

first and second flanges having substantially circular perimeters disposed respectively at said first and second axial ends of the winding drum and having a diameter greater than a diameter of said drum to hold said filament therebetween, said first and second flanges each having facing inner surfaces and outer surfaces;

retaining means for retaining said filament disposed on at least said first flange;

said retaining means including a catcher having base portion at a first end of said catcher fixed to the outer surface of said first flange, a hook portion at a second end of said catcher, an intermediate portion connecting said base and hook portions, and said first flange defining an access hole having a size large enough to accept said hook portion for passage therethrough from a first position outside of said access hole to a second position beyond a plane of said access hole and between said first and second flanges said hook portion being configured to accept and hold said filament between said hook portion and said inner surface of said first flange;

said intermediate portion extending from said base portion at a trajectory displacing said intermediate portion outwardly from said outer surface of said first flange and toward said access hole in said first flange to position said hook portion in functional alignment with said access hole; and said catcher having a resilience sufficient to permit elastic deflection of said intermediate portion to displace said hook portion from said first position to said second position when a force is applied thereto, thereby allowing said hook portion to return toward said first position upon removal of said force for clamping said filament between said hook portion and said inner surface of said first flange.

2. A filament take-up reel according to claim 1, wherein the catcher is made of a metallic leaf spring.

3. A filament take-up reel according to claim 1, wherein the catcher is made of a resilient rod.

4. The filament take-up reel according to claim 1 wherein said hook portion has a width less than a width of said base portion.

5. The filament take-up reel according to claim 1 wherein:

said retaining means is formed from a plate having first and second ends and edges;

said plate having first and second parallel cuts extending parallel to said first and second edges and from said second end to a position short of said first end; and said first and second parallel cuts defining said intermediate portion and said hook portions between said parallel cuts and said base portion outside said parallel cuts.

6. The filament take-up reel according to claim 5 wherein:

said base portion includes parallel tabs extending along said parallel cuts with tab ends defined by said second end of said plate; and said flanges having swaged tubular annular peripheries reinforced edges with said tab ends swaged within said reinforced edges.

7. A filament take-up reel having a winding drum for accepting a winding of a filament thereon, said take-up reel comprising:

said winding drum having first and second axial ends;

first and second flanges having substantially circular perimeters disposed respectively at said first and second axial ends of the winding drum and having a diameter greater than a diameter of said drum to hold said filament therebetween, said first and second flanges each having facing inner surfaces and outer surfaces;

retaining means for retaining said filament, said retaining means being disposed on at least said first flange;

retaining means for retaining said filament disposed on at least said first flange;

said retaining means including a catcher having base portion at a first end of said catcher fixed to the outer surface of said first flange, a hook portion at a second end of said catcher, an intermediate portion connecting said base and hook portions, and said first flange defining an access hole within said substantially circular perimeter having a size large enough to accept said hook portion for passage therethrough from a first position outside of said access hole to a second position beyond a plane of said access hole and between said first and second flanges said hook portion being configured to accept and hold said filament between said hook portion and said inner surface of said first flange; and said catcher having a resilience sufficient to permit elastic deflection of said catcher to displace said hook portion from said first position to said second position when a force is applied thereto, thereby allowing said hook portion to return toward said first position upon removal of said force for clamping said filament between said hook portion and said inner surface of said first flange.

8. A filament take-up reel according to claim 7 wherein the catcher is made of a metallic leaf spring.

* * * * *